United States Patent [19]

Pettersson et al.

[11] Patent Number: 4,593,620

[45] Date of Patent: Jun. 10, 1986

[54] PROPELLANT CHARGE COMPONENT FOR USE WITH A PROJECTILE FOR MUZZLE-LOADED WEAPONS

[75] Inventors: Rolf Pettersson, Ärla; Claes Tisell, Eskilstuna, both of Sweden

[73] Assignee: Affärsverket FFV, Eskilstuna, Sweden

[21] Appl. No.: 638,469

[22] PCT Filed: Feb. 9, 1984

[86] PCT No.: PCT/SE84/00042

§ 371 Date: Aug. 6, 1984

§ 102(e) Date: Aug. 6, 1984

[87] PCT Pub. No.: WO84/03141

PCT Pub. Date: Aug. 16, 1984

[30] Foreign Application Priority Data

Feb. 9, 1983 [SE] Sweden ..... 8300664

[51] Int. Cl.[4] ..... F42B 13/22

[52] U.S. Cl. ..... 102/372

[58] Field of Search ..... 102/372, 373, 342, 357, 102/374, 483

[56] References Cited

FOREIGN PATENT DOCUMENTS 147159 11/1982 Norway .
498361 12/1970 Switzerland .

*Primary Examiner*—Charles T. Jordan
*Assistant Examiner*—Ted L. Parr
*Attorney, Agent, or Firm*—Fleit, Jacobson, Cohn & Price

[57] ABSTRACT

Propellant charge component for use with a projectile (4) for muzzle-loaded weapons. The propellant charge component (5) and the projectile (4) are each capable of being loaded into the weapon separately. The propellant charge component (5) is provided with a piston (14) which is capable under the effect of gases from the propellant charge component (5) of being separated from the propellant charge component (5) in the direction of firing of the projectile until it comes up against a stop organ (17) arranged on the propellant charge component (5), whereby the impact against the stop will impart kinetic energy to the propellant charge component (5) causing it to be ejected from the weapon.

2 Claims, 3 Drawing Figures

PROPELLANT CHARGE COMPONENT FOR USE WITH A PROJECTILE FOR MUZZLE-LOADED WEAPONS

The present invention relates to a propellant charge component for use with a projectile for muzzle-loaded weapons.

Projectiles for muzzle-loaded weapons usually exhibit an ogival-shaped shell body with a tail assembly containing a propellant charge component in the form of a cartridge tube surrounded by wings or fins and which encloses an ignition or propellant cartridge consisting of an appropriate powder. In addition to this cartridge, a further quantity of powder may also be provided on the outside of the cartridge tube, usually in the form of a number of increment charges. The cartridge tube is provided with a number of transcurrent holes to form an exit route for the powder gases. The gases not only drive the shell forwards, but also provide the necessary ignition impulse for any increment charges which may be present on the outside of the cartridge tube.

It is also possible to execute the propellant charge component and the shell body as two separate parts, each of which can be loaded into the weapon separately, whereby only the shell body will be expelled from the weapon, with the propellant charge component being left behind. For this purpose, the fins of the projectile are so arranged as to be in a position in which they are folded down onto the shell body, from where they are extended as soon as the shell body has left the barrel of the weapon. The advantage of using this form of division is that all the available kinetic energy can be utilized purely for the acceleration of the shell body. The problem associated with division, however, is the inability to remove the spent propellant charge component from the weapon rapidly and without the use of a great deal of energy, so that the weapon may be reloaded.

One method of ejecting a spent propellant charge from a barrel is described in Swiss Patent Specification No. 498.361. According to this Specification, a piston is so arranged as to expel the projectile from the barrel in the manner of a sabot, at the same time as the piston, once it has covered a pre-determined distance, will come up against a stop organ arranged on the propellant charge component so that the piston will transfer kinetic energy to the propellant charge component, causing it to be ejected from the barrel.

A disadvantage of the previously disclosed arrangement is that the projectile is affected by acceleration forces only for as long as the piston is moving. Once the piston has come up against the stop organ, the function of the piston as a sabot will cease.

The purpose of the present invention is, therefore, to provide the ejection of the spent propellant charge component at the same time as the acceleration forces acting on the projectile are permitted to act during the entire travel of the projectile through the barrel. This object is achieved by endowing the propellant charge component with the characteristic features indicated in claim 1.

The invention is described below in greater detail with reference to the accompanying drawing, which illustrates a preferred embodiment of the invention.

Figure 1:
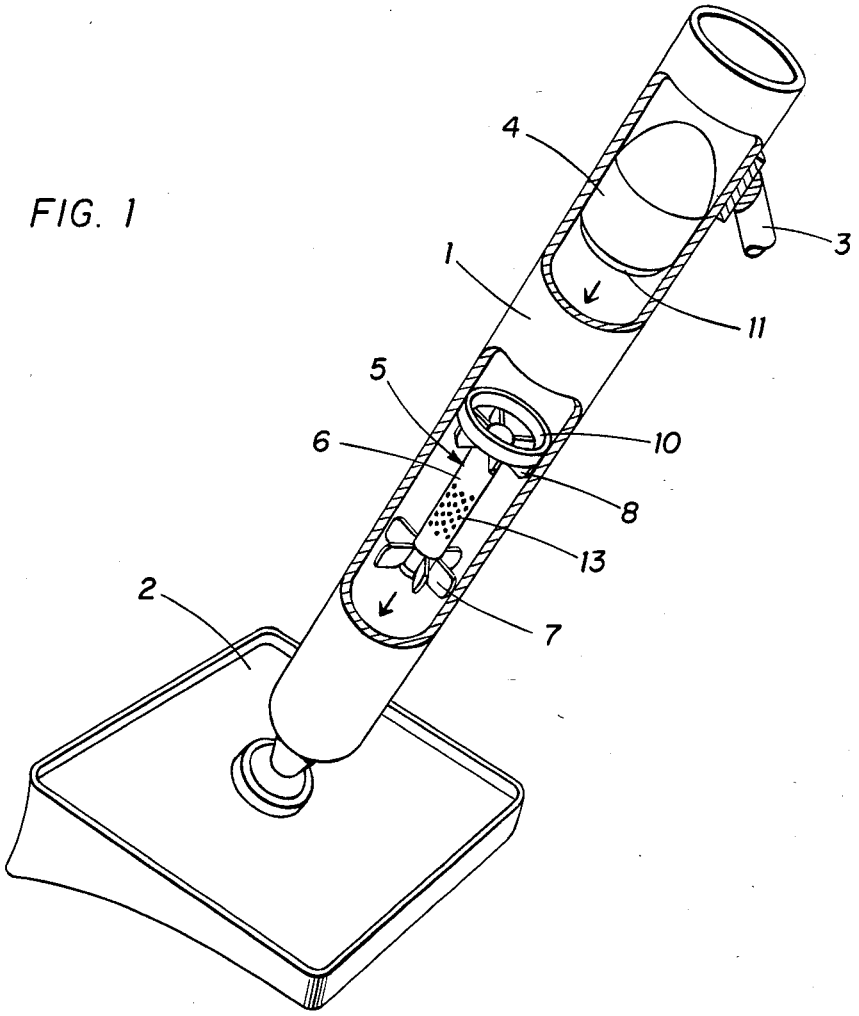
FIG. 1 shows a perspective view of a mortar, the barrel of which is partially sectioned to show how the propellant charge component in accordance with the invention and the associated projectile are each loaded into the barrel.

The mortar illustrated in FIG. 1 consists of a barrel 1, preferably with a smooth bore, a base plate 2 and a support 3, which is not illustrated in full in the Figure. The associated shell consists in accordance with the invention of a projectile 4 containing, amongst other things, a payload such as a sustainer and/or a warhead of a type not illustrated in detail, and of a propellant charge component 5 with a conventional propellant charge (not shown here) for driving the projectile forwards.

The warhead may, for instance, consist of a shaped charge with a directional explosive effect. Since such warheads are already generally familiar, it is not considered necessary to describe them in any greater detail here. The sustainer is also a component which is familiar to an expert, for which reason it is not described in any greater detail here.

The projectile 4 is, for convenience, shown in FIG. 1 to be of relatively short length, whereas normally its length is considerably greater than its calibre. The projectile 4 and the propellant charge component 5 are shown in FIG. 5 on their way down the barrel 1 towards a loaded position at the bottom of the barrel.

The propellant charge component 5 comprises a cartridge tube 6 provided at its ends with arms 7, 8 arranged in two star-shaped groupings for the purpose of centering the cartridge tube in the barrel of the mortar. These centering arms, of which one grouping 7 is attached to the rear end of the cartridge tube and the other grouping 8 is attached to a cylindrical prolongation 9 of the front end of the cartridge tube, are executed within the groupings in the form of plates of identical shape projecting radially from the cartridge tube 6 and the prolongation 9, respectively.

A belt 10 intended to protect the projectile 4 from gases from the cartridge tube 6 is attached to the arms 8 of the cartridge tube 6. The belt, which may be made of, for example, polytetrafluoroethylene or some similar material, exhibits a cylindrical internal surface which tapers conically towards the front and forms the seating for a corresponding annular shoulder 11 on the rear end of the projectile 4.

The belt 10 does not constitute part of the present invention. In order better to appreciate the process involved in the firing of the mortar, it is considered appropriate however, to give a brief description of a conceivable embodiment and function of the belt.

The belt 10 is preferably a so-called lipped belt which is attached to the arms 8 by means of two annular lips 10*a* and 10*b* which exert a grip around a number of claw-shaped hooks on the arms 8. Under the effect of gases from the cartridge tube 6 the lips 10*a* and 10*b* are caused to open slightly so as to release their grip on the hooks, thereby causing the belt to be held tightly against the shoulder 11 of the projectile for the duration of the period when the propellant gases inside the barrel are acting upon the projectile.

The cartridge tube 6 contains in a conventional fashion a propellant charge 12, the gases from which are able to flow out via holes 13 in the wall of the tube 6 for the purpose of causing the projectile to be driven forwards. In order to increase the range, increment charges may, also in a previously disclosed fashion, be attached to the tube 6.

The prolongation 9 of the cartridge tube 6 is able to move to a limited extent in relation to the cartridge tube 6 because it incorporates a piston 14 which is able to run in a cylinder 15 formed inside the tube 6. It is, of course, conceivable to swap the positions of the piston 14 and the cylinder 15 in an alternative embodiment. The bottom of the cylinder faces towards the propellant charge 12, for which reason gases from the latter will endeavour to force the piston 14 out of the cylinder 15.

Figure 2:
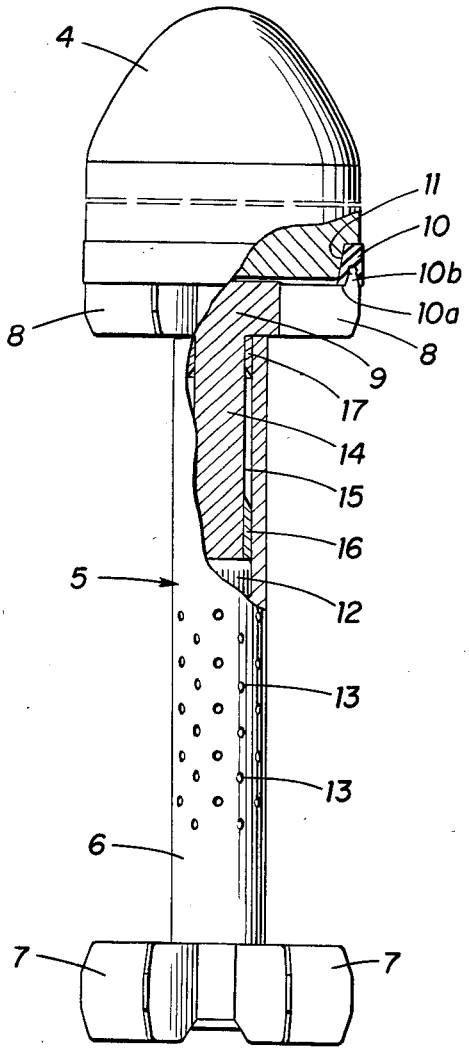
FIGS. 2 and 3 show a partially sectioned longitudinal view of two different phases in the firing of a projectile, which is provided with a propellant charge component in accordance with the invention.
Figure 3:
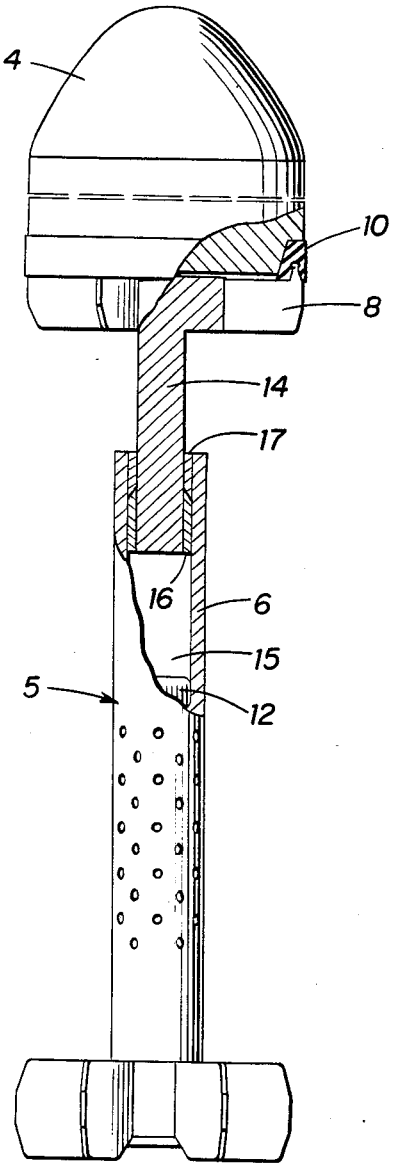

The stroke of the piston 14 is determined by an annular stop organ 16 on the rear part of the piston and by an annular stop organ 17 which interacts with it at the mouth of the cylinder 15. The stop organs 16 and 17 are attached respectively to the piston and in the cylinder by means of threaded unions, welding or brazing, etc. The two limit positions of the piston 14 are shown in FIGS. 2 and 3, of which FIG. 2 shows the inner limit position in which the piston 14 is fully introduced into the cylinder 15, and of which FIG. 3 shows the outer limit position in which the stop organ 16 of the piston is up against the stop organ 17 of the cylinder.

Firing of the projectile takes place in the following manner.

The propellant charge component 5 with the belt 10 attached and the projectile 4 are each introduced separately in the above order through the mouth of the barrel 1 of the mortar (see FIG. 1) so that they slide with the help of gravity to their full extend down the barrel until they reach a pre-determined loaded position at the bottom of the barrel. The shoulder 11 of the projectile 4 will then lie loosely against the inner surface of the belt 10, as illustrated in FIG. 2. According to an alternative embodiment, the shoulder 11 and the belt 10 are so dimensioned that the shoulder 11 is tightly attached to the inner surface of the belt.

Once the projectile 4 and the propellant charge component 5 have adopted the loaded position in the mortar barrel, firing of the weapon takes place by igniting the propellant charge 12. This may be done by means of, for example, a conventional percussion charge (not shown) in the base of the cartridge tube 6 which may be actuated in a previously disclosed fashion, for instance by the use of a firing lanyard or by electrical means. The propellant gas thus generated flows out through the holes 13 in the cartridge tube and into the surrounding space in the barrel, where a gas pressure is formed which acts upon the rear face of the projectile 4, causing the projectile 4 to be accelerated along the barrel.

At the same time as the projectile 4 is caused to accelerate by the propellant gases, the piston 14 is caused to accelerate in the same direction due to the fact that propellant gases from the propellant charge 12 also flow into the cylinder 15 (see FIG. 3). The piston 14 with the arms 8 and the belt 10 are propelled along the barrel over a distance which corresponds to the stroke of the piston 14 in the cylinder 15. The other part of the propellant charge component 5 will at this time remain in the loaded position.

When the stop organ 16 on the piston 14 comes up against the stop organ 17 (see FIG. 3) the piston 14 will be caused to slow down, imparting a severe jolt which will cause the kinetic energy of the piston to be transferred to the propellant charge component 5, thereby causing the latter to be ejected from the barrel.

As previously indicated, the propellant gases will expand the lips 10*a* and 10*b* of the belt so that the belt will release its grip on the propellant charge component 5 and will instead become tightly attached to the shoulder 11 of the projectile. As soon as the projectile has left the mouth of the barrel the gas pressure behind the projectile will fall, causing the lips of the belt to close slightly so that the belt will fall away from the projectile, which will now continue on its own towards the target.

The expression projectile used in this Patent shall also be understood to denote any rearward extension components for the projectile, such as sustainers, which are capable of being connected to the rear of a projectile.

We claim:

1. Propellant charge component (5) for use with a projectile (4) for muzzle-loaded weapons, said propellant charge component (5) exhibiting a space (15) inside which an element (14) is capable under the effect of gases from the propellant charge component (5) of being displaced over a certain distance in the direction of firing of the projectile (4) until it comes up against a stop organ (17) arranged on the propellant charge component (5), whereby the impact against the stop will impart kinetic energy to the propellant charge component (5) causing it to be ejected from the weapon, characterised in that the propellant charge component (5) is so arranged as also to give off gas into a space surrounding the propellant charge component in the barrel (1) of the weapon, so that a gas pressure acting upon the rear part of the projectile can be built up in the last-mentioned space for the purpose of causing the projectile to accelerate from the barrel at the same time as said element (14) describes said movement in the first-mentioned space (15).

2. Propellant charge component in accordance with claim 1, characterised in that the moving element (14) consists of a piston, and in that the first-mentioned space (15) consists of a cylinder arranged in the propellant charge component (5).

* * * * *